US006273200B1

(12) United States Patent
Smith et al.

(10) Patent No.: US 6,273,200 B1
(45) Date of Patent: Aug. 14, 2001

(54) SCREWDRIVER WITH MANUEL SPINDEL LOCK

(75) Inventors: Roger Q. Smith, Reisterstown, MD (US); Tong Chi Kin, Sai Kung (HK); Fung Chi Ho, Kowloon (HK); Lam Kar Lok, Sai Ying Poon (HK)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/348,895

(22) Filed: Jul. 7, 1999

(51) Int. Cl.[7] ..... B25B 17/00

(52) U.S. Cl. ..... 173/216; 173/29; 173/217; 81/57.11; 81/58.3; 279/147

(58) Field of Search ..... 173/216, 217, 173/29, 47, 48, 164; 81/57.11, 475, 60, 58.3; 279/150, 147; 188/69

(56) References Cited

U.S. PATENT DOCUMENTS

| | | | | |
|---|---|---|---|---|
| 2,341,529 | | 2/1944 | Cohen | 279/147 |
| 2,436,540 | | 2/1948 | Allenby | 279/147 |
| 2,575,903 | | 11/1951 | Youhouse | 279/147 |
| 2,857,997 | * | 10/1958 | Graybill | 81/475 |
| 2,872,197 | | 2/1959 | Happe | 188/69 |
| 2,979,089 | | 4/1961 | Piesker | 173/217 |
| 3,021,723 | | 2/1962 | Happe | 279/150 |
| 3,329,185 | * | 7/1967 | Hettich et al. | 173/217 |
| 3,802,518 | * | 4/1974 | Albert | 173/29 |
| 3,872,951 | | 3/1975 | Hastings, Jr. | 279/150 |
| 3,958,469 | | 5/1976 | Meese | 81/58.3 |
| 4,159,050 | | 6/1979 | Hopkins, Sr. et al. | 81/58.3 |
| 4,249,435 | | 2/1981 | Villeneuve et al. | 81/58.3 |
| 4,323,324 | | 4/1982 | Ebrhardt | 279/134 |
| 4,400,995 | | 8/1983 | Palm | 173/164 |
| 4,448,098 | * | 5/1984 | Totsu | 81/57.11 |
| 4,754,669 | * | 7/1988 | Verdier et al. | 81/60 |
| 4,804,048 | | 2/1989 | Porth, Jr. | 173/47 |
| 4,878,405 | | 11/1989 | Wolfe | 81/57.11 |
| 5,016,501 | | 5/1991 | Holzer, Jr. | 81/57.11 |
| 5,025,903 | * | 6/1991 | Elligson | 173/29 |
| 5,251,706 | | 10/1993 | Evans | 173/29 |
| 5,282,510 | * | 2/1994 | Pacher | 173/48 |
| 5,496,139 | | 3/1996 | Ghode et al. | 188/69 |
| 5,692,575 | | 12/1997 | Hellström | 173/216 |

FOREIGN PATENT DOCUMENTS

| | | |
|---|---|---|
| 1078958 | 3/1960 | (DE) . |
| 1478828 | 3/1969 | (DE) . |
| 3636301 A1 | 4/1988 | (DE) . |
| G 8902 467.2 | 9/1989 | (DE) . |
| 4128651 A1 | 3/1993 | (DE) . |
| 4342464 A1 | 6/1995 | (DE) . |
| 19608499 A1 | 9/1997 | (DE) . |
| 0 088 836 | 9/1986 | (EP) . |
| 0 118 215 | 5/1989 | (EP) . |

* cited by examiner

*Primary Examiner*—Scott A. Smith
(74) *Attorney, Agent, or Firm*—Harness, Dickey & Pierce, P.L.C.

(57) ABSTRACT

A power tool has a manual spindle lock which includes a first locking member to couple with a gear of the power tool drive train. The locking member includes a first cam member. A second cam member is coupled with the first cam member. The second cam member is movable between first and second positions. In the first position, the locking member is disengaged from the gear and in the second position the locking member engages with the gear to prohibit driving of the output spindle of the power tool.

36 Claims, 3 Drawing Sheets

SCREWDRIVER WITH MANUEL SPINDEL LOCK

BACKGROUND OF THE INVENTION

The present invention relates to power tools and, more particularly, to power tools such as power screwdrivers with manual spindle locks.

Varying torque or force is applied to a fastener as the fastener, such as a screw or bolt, is advanced into or removed from an anchoring position. Ordinarily, large forces are required to set the screw during installation or to initially break loose the screw during removal. In small power tools, difficulties are encountered in generating these large forces. The underlying limitation of these tools is the motor horsepower. This problem is further aggravated in battery operated tools. In battery operated tools, to have sufficient electrical capacity from the battery to operate a high torque power tool, a large heavy size tool is required. Thus, lightweight self-contained battery operated tools are limited in the amount of torque which can be produced.

To alleviate the shortcomings, the prior art teaches conventional screwdrivers being utilized with power tools to deliver the high torque. Also, elaborate drive trains may be associated with the power tool to deliver the increased torque. However, this lowers the drive speed. Further, different types of shaft locks have been provided. The shaft locks provide the powered screwdriver with the high torque feature of a manual screwdriver when required. Thus, it is desirable to have a power tool with a manual spindle lock to be utilized in high torque situations.

SUMMARY OF THE INVENTION

It is an object of the present invention to provide a compact lightweight power tool with conventional shaft speeds that is capable of supplying sufficient torque and includes a manual spindle lock which may be utilized when high torque situations exist. The present invention provides a simple cost-effective design to provide a spindle lock with a power tool such as a compact power screwdriver.

In accordance with a first aspect of the invention, a power tool with a manual spindle lock comprises a housing with a motor positioned in the housing. A power source is coupled with the motor. An activation member is coupled with the motor and the power source to energize and de-energize the motor. An output spindle is coupled with the motor. An output gear is coupled with the output spindle. A locking member, which couples with the output gear, includes a first cam member. A second cam member is coupled with the first cam member and is movable between a first and second position. In the first position, the locking member is disengaged from the output gear and in the second position the locking member engages the output gear prohibiting driving of the output spindle. A drive train is coupled between the motor and output spindle to drive the output spindle. The drive train includes the output gear and a stationary gear housing surrounds the drive train to cooperate with the drive train and the locking member.

In accordance with a second aspect of the invention, a spindle lock for a power tool comprises a first member with a hollow cylindrical portion defining a wall with an inner surface and an outer surface. A mechanism on the wall is adapted to engage a drive train of the power tool. A first cam member is coupled with the hollow cylindrical portion. A second member includes an activation member. A second cam member on the second member is coupled with the first cam member. The activation member is moved between first and second positions which, in turn, moves the hollow cylindrical member between a disengagement position and engagement position with the drive train. The activation member has an annular body adapted to surround a spindle and is rotatable from the first to the second position. The first and second cam members are a pin and a helical slot or, alternatively, first and second partial threads. The inner wall includes teeth to engage the drive train and the outer wall includes teeth or splines to engage the housing. The second member is rotated which, in turn, axially moves the first member. The first cam member includes a cantilever portion extending from the hollow cylinder and a cam element on the cantilevered portion.

In accordance with a third aspect of the invention, a power screwdriver comprises a first member with a hollow cylindrical portion defining a wall with an inner surface and an outer surface. A mechanism on the wall is adapted to engage a drive train of the power tool. A first cam member is coupled with the hollow cylindrical portion. A second member includes an activation member. A second cam member on the second member is coupled with the first cam member. The activation member is moved between the first and second position which, in turn, moves the hollow cylindrical member between a disengagement position and engagement position with the drive train. The activation member has an annular body adapted to surround a spindle and is rotatable from the first to the second position. The first and second cam members are a pin and a helical slot or, alternatively, first and second partial threads. The inner wall includes teeth to engage the drive train and the outer wall includes teeth or splines to engage the housing. The second member is rotated which, in turn, axially moves the first member. The first cam member includes a cantilever portion extending from the hollow cylinder and a cam element on the cantilevered portion.

From the following detailed description, taken in conjunction with the drawings and subjoined claims, other objects and advantages of the present invention will become apparent to those skilled in the art.

DETAILED DESCRIPTION OF THE PREFERRED EMBODIMENT

Figure 1:
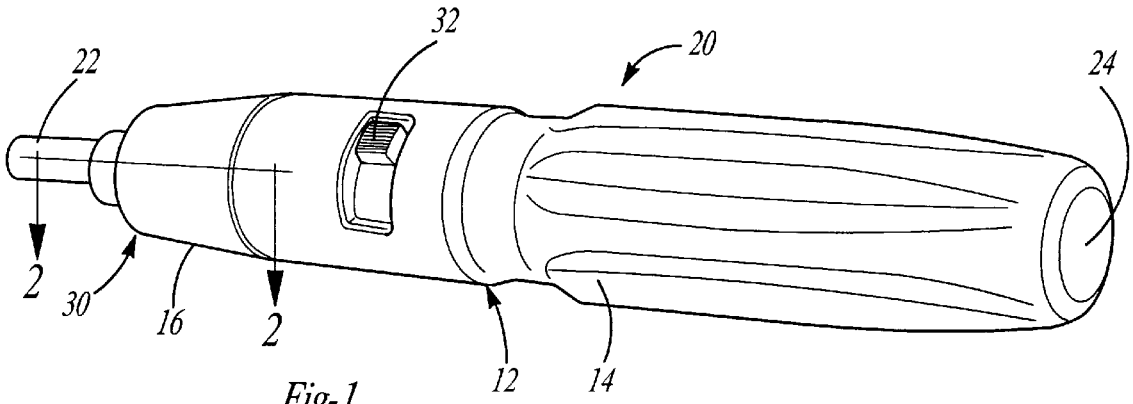
FIG. 1 is a perspective view of a power tool in accordance with the present invention.

Turning to FIG. 1, a power tool such as a power screwdriver is illustrated and designated with the reference numeral 10. The power tool 10 includes a housing 12 with a motor housing portion 14 and a gear housing portion 16. A motor 18 is housed within the motor housing portion 14 and a gear train 20 is housed within the gear housing portion 16. An output spindle 22 is coupled with the gear train 20 and is driven by the motor 14. Also, a battery 24 is electrically coupled with the motor 18 and is positioned within the motor housing 14. A spindle locking device 30 is coupled with the housing as will be described herein.

The power tool 10 includes an activation switch 32 such as a toggle switch for energizing and de-energizing the motor. The switch 32 is connected between the battery 24 and the motor 18. Upon energizing the motor 18, the pinion gear 34 at the end of the motor shaft 36 is rotated. The pinion gear 34, in turn, rotates a first set of planet gears 38 which, in tum, rotate sun gear 40. Sun gear 40 in turn rotates a second set of planetary gears 42 which, in turn, rotate the output carrier gear 44. The output carrier gear 44 is coupled with the output shaft 22. The gear housing portion 16 includes teeth 46 peripherally positioned on the inner surface of the gear housing portion 16. The teeth 46 mesh with the first and second set of planet gears 38 and 42.

The spindle lock 30 engages and disengages the output gear 44 which locks the gear train 20 to enable the power tool to be used manually. The spindle lock 30 includes a first member 50 and a second member 52.

The first member 50 includes an annular or ring member 54 with a plurality of projecting cantilevered fingers 56. The annular member 54 includes outer circumferential teeth 57 to couple with teeth or splines 46 on the inner peripheral surface of the gear housing portion 16. The annular member 54 has internal teeth 60 which mesh with the teeth 62 of the output carrier gear 44. The annular member 52 is open at the tooth end and has a radial wall 64 partially closing the other end of the annular member. The radial wall 64 has a central opening 66 which is positioned around the spindle housing portion 68 of the gear housing portion 16.

The projecting fingers 56 extend from the radial wall 64. The fingers 56 include cam elements 70. The cam elements 70 are illustrated as projecting pins. The projecting fingers 56 with the cam elements 70 are generally unitarily formed with the annular member 54. The first member 50 may be formed from a plastic or metallic material.

The second member 52 is positioned around the projecting members 56 and the spindle housing 68. The second member 52 has a ring portion 72 and an end wall 74 extending radially inward from the ring 72. The radial wall 74 has a central opening 76 which is positioned around the spindle housing 68. A clip ring or washer 78 maintains the second member 52 onto the gear housing portion 16.

The ring 72 includes an interior peripheral surface 80. The interior peripheral surface 80 includes a pair of parallel ribs 82, 84 which define a cam slot 86. The ribs 82 and 84, while parallel to one another, define a helical path such that the ribs 82 and 84 move away from the radial end wall 74 along their peripheral path. Accordingly, the cam slot 86 likewise moves away from the radial wall 74 along a helical path.

Figure 2:
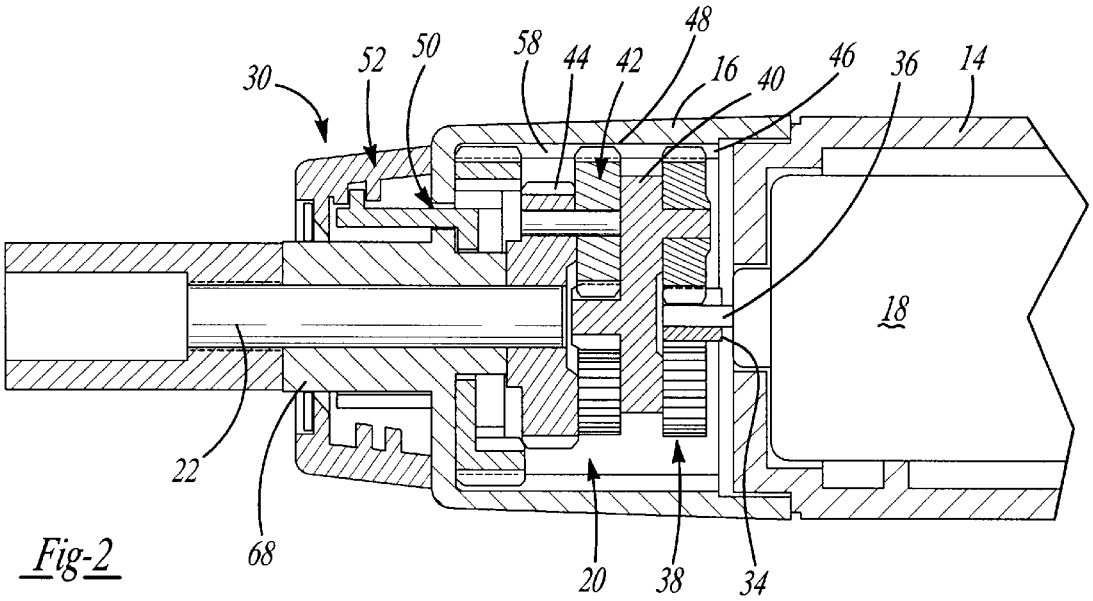
FIG. 2 is a cross-section view of FIG. 1 along line II—II thereof.
Figure 3:
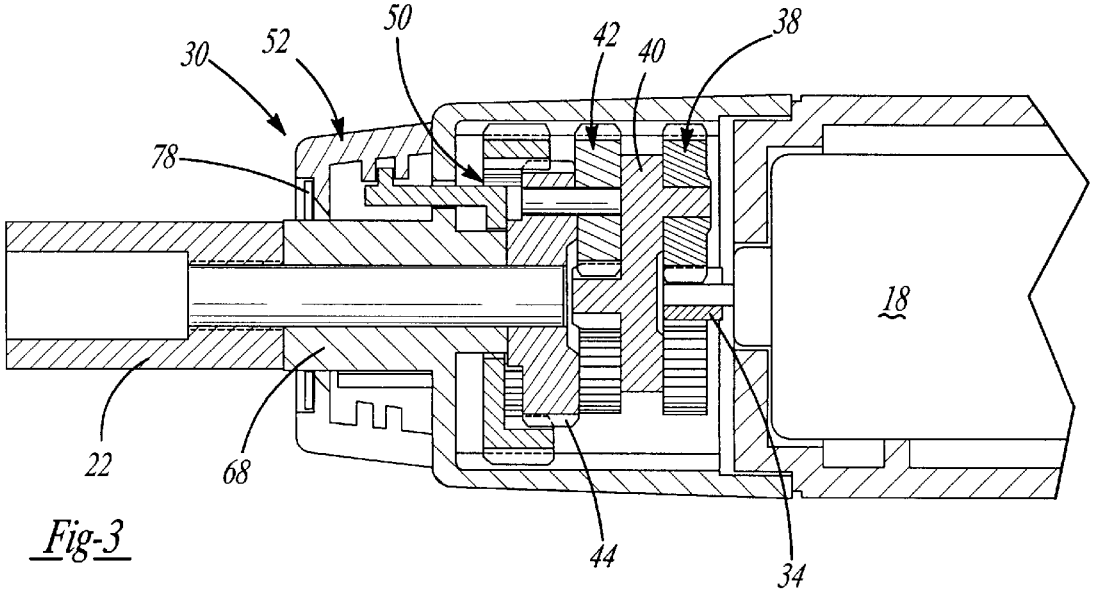
FIG. 3 is a cross-section view like FIG. 2 in an engaged position.
Figure 4:
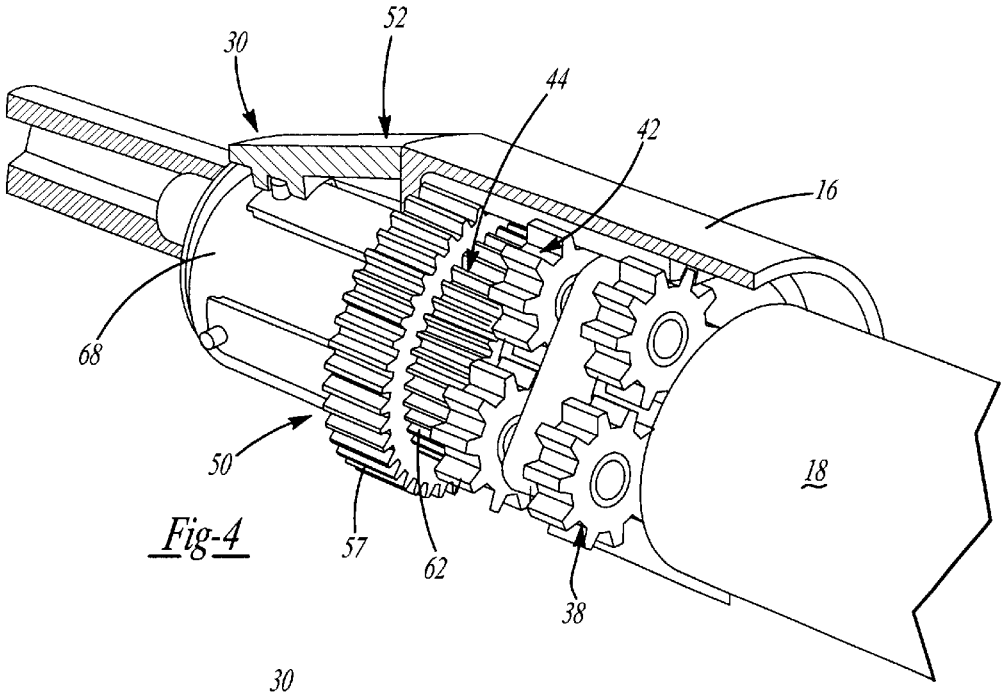
FIG. 4 is a perspective view partially in cross-section of the power tool of FIG. 1.
Figure 5:
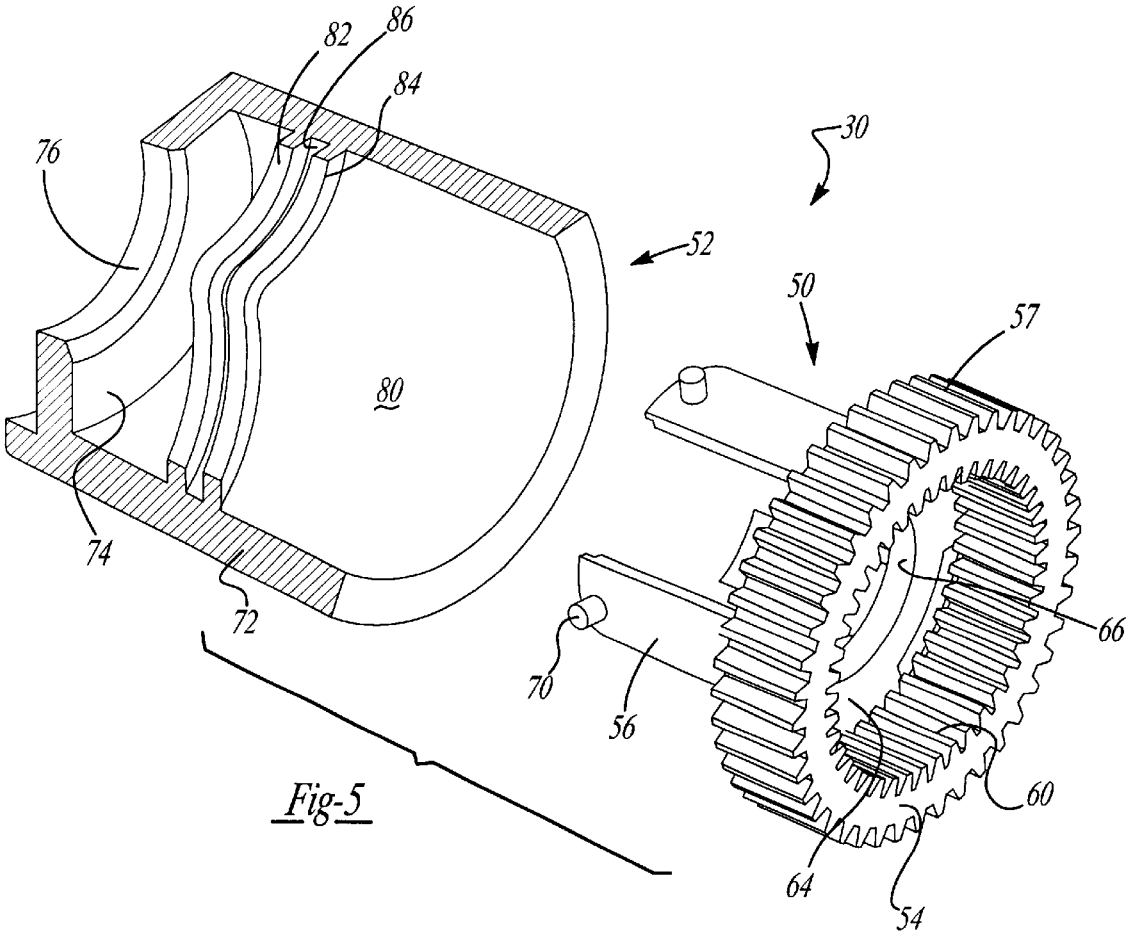
FIG. 5 is an exploded view of the power tool of FIG. 1 partially in section.

Cam elements 70 fit within the cam slot 86. Thus, as the ring 72 is rotated, the cam elements 70 are moved along the helical path away from the radial wall 74. The cam elements 70 move axially. Accordingly, the extending fingers 56, as well as the annular member 54, move axially. As the annular member 54 moves axially, the teeth 60 engage with the teeth 62 of the output carrier gear 48. This is best seen in FIGS. 2 and 3. Thus, as the teeth 60 engage the output carrier gear teeth 62 the drive train 20 is locked. This is due to the fact that the outer teeth 56 of the annular member 54, which slide in teeth 46, are fixed against rotation in the gear housing portion 16. Thus, the power tool may be used in a manual position.

Figure 6:
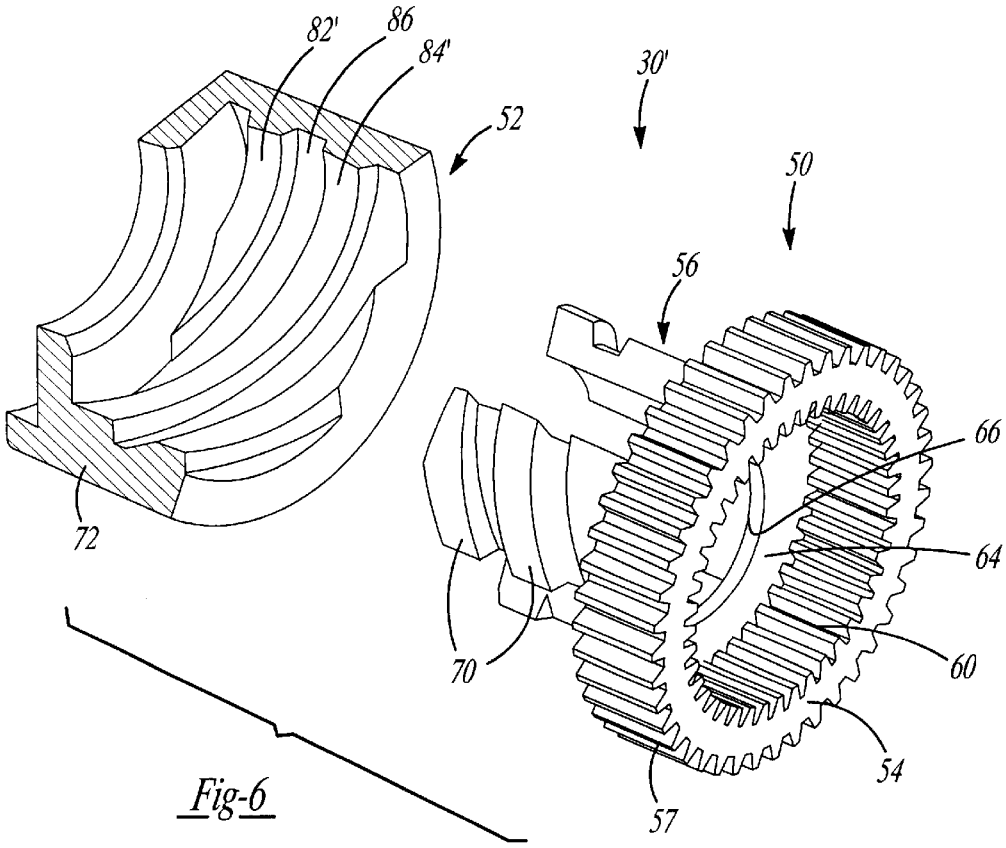
FIG. 6 is a view like FIG. 5 of an alternate embodiment of the present invention.

Turning to FIG. 6, a second embodiment of the present invention is shown. In FIG. 6, a spindle lock 30' is illustrated. The elements which are the same as those previously disclosed are identified with the same reference numerals. The difference between the above described spindle lock and the spindle lock of FIG. 6 is that the cam elements 70 are partial thread members 70' which mate with partial thread elements 82' of the second member 52. Thus, as the second member 52 is rotated clockwise and counter-clockwise, the threads 70' move along a helical path towards and away from the radial wall 74 which, in turn, axially moves the annular member 54 engaging and disengaging annular member teeth 60 with output gear 62. Thus, the spindle lock 30' operates similarly to the spindle lock 30 described above.

Figure 7:
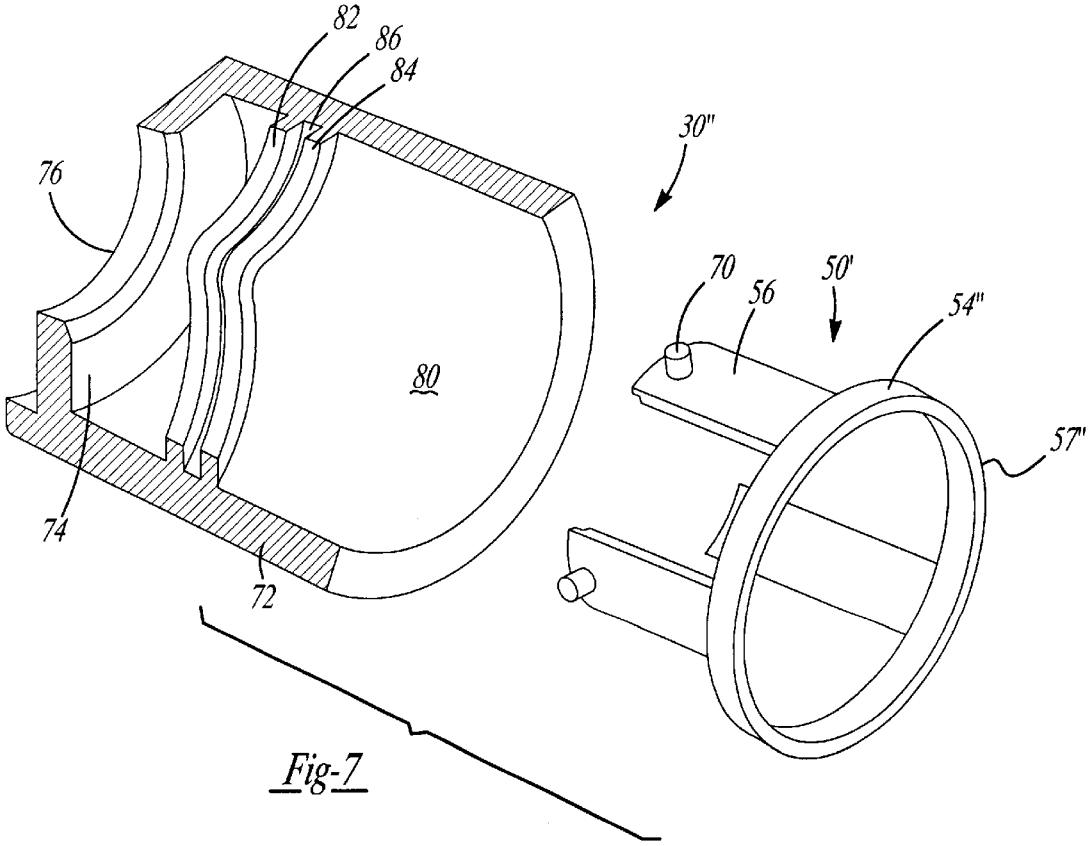
FIG. 7 is a view like FIG. 5 of another embodiment of the present invention.

Turning to FIG. 7, a third embodiment of the present invention is shown. In FIG. 7, a spindle lock 30" is illustrated. The elements which are the same as those previously disclosed are identified with the same reference numerals. The difference between the above-described spindle lock and the spindle lock of FIG. 7 is that the first member does not include a large annular member with outer circumferential teeth which would couple with teeth 46 of the inner periphery surface of the gear housing portion 16. The first member 50' includes projecting members 56 with cams 70 which are pins. The annular member 54" is a circular ring. The end surface 57" would frictionally engage the gear carrier 44 like that illustrated in FIG. 3. Thus, the frictional contact between the end face 57" and the output carrier 44 would prohibit rotation of the output carrier as well as the gear train to manually lock the gear train. Also, the surface 57" may include a plurality of recesses (shown in phantom) which would receive projections from the output carrier 44 (not shown) to effectively connect the ring 54" with the output carrier 44.

While the above detailed description describes the preferred embodiment of the present invention, the invention is susceptible to modification, variation, and alteration without deviating from the scope and fair meaning of the subjoined claims.

What is claimed is:

1. A power tool with a manual spindle lock, comprising:

a housing;

a motor in said housing;

a power source coupled with said motor;

an activation member coupled with said motor and power source for energizing and de-energizing said motor;

an output spindle coupled with said motor;

an output gear coupled with said output spindle;

a locking member for coupling with said output gear, said locking member including a first cam member; and a second cam member, said second cam member coupled with said first cam member and movable between a first and second position, wherein in said first position said locking member being disengaged from said output gear and in said second position said locking member engaging said output gear prohibiting driving of said output spindle.

2. The power tool according to claim 1, wherein a drive train being coupled between said motor and said output spindle for driving said output spindle and said drive train including said output gear and a stationary gear housing surrounding said drive train for cooperating with said drive train.

3. The power tool according to claim 2, wherein said locking member coupling with said housing.

4. The power tool according to claim 3, wherein said locking member including teeth meshing with teeth in said housing and said locking member including teeth for engaging teeth on said output gear.

5. The power tool according to claim 1, wherein said first cam member including a projecting member received in a slot in said second cam member.

6. The power tool according to claim 1, wherein said second cam member being rotatable and axially moving said locking member on said output spindle.

7. The power tool according to claim 1, wherein said locking member including a gear ring having teeth on an interior surface of said ring and at least one tooth on the exterior of said ring, at least one finger projecting from said ring, said finger including said first cam member for engaging said second cam member.

8. The power tool according to claim 7, wherein said first cam member being a pin.

9. The power tool according to claim 7, wherein said first cam member being a partial helical thread.

10. The power tool according to claim 1, wherein said second cam member including a hollow cylinder portion with a helical cam slot on an interior peripheral surface of said cylinder portion, said cam slot receiving said first cam member.

11. The power tool according to claim 10, wherein said cam slot being defined by partial helical threads.

12. The power tool according to claim 1, wherein said locking member including a ring having a friction surface for engaging and disengaging said output gear and at least one finger projecting from said ring, said finger including said first cam member for engaging said second cam member.

13. The power tool according to claim 12, wherein said friction face includes one or more recesses for engaging and disengaging said output gear.

14. A spindle lock for a power tool, comprising:

a first member having a hollow cylindrical portion defining a wall with an inner surface and an outer surface;

a mechanism on said wall adapted to engage a drive train of the power tool, and a first cam member coupled with said hollow cylindrical portion;

a second member including an actuation member and a second cam member, said second cam member coupled with said first cam member wherein said actuation member is moved between a first position and a second position which in turn moves said hollow cylindrical member between a disengagement position and an engagement position with the drive train.

15. The spindle lock according to claim 14, wherein said activation member having an annular body adapted to surround a spindle and rotatable between the first and second position.

16. The spindle lock according to claim 14, wherein said first and second cam member being a pin in a helical slot.

17. The spindle lock according to claim 14, wherein said first and second cam members being partial threads.

18. The spindle lock according to claim 14, wherein said first member inner surface includes teeth for engaging the drive train and said outer surface includes teeth adapted for engaging a housing.

19. The spindle lock according to claim 14, wherein said second member being rotated which, in turn, axially moves said first member.

20. The spindle lock according to claim 14, wherein said first cam member includes a cantilever portion extending from said hollow cylinder and a cam element on said cantilever portion.

21. The spindle lock according to claim 14, wherein said first member includes a plurality of cam members.

22. The spindle lock according to claim 14, wherein said mechanism being friction end face for engaging said drive train.

23. The spindle lock according to claim 22, wherein said friction end face includes at least one recess.

24. A screwdriver with a manual spindle lock, comprising:

a housing;

a motor in said housing;

a power source coupled with said motor;

an activation member coupled with said motor and power source for energizing and de-energizing said motor;

an output spindle coupled with said motor for driving said output spindle;

an output gear coupled with said output spindle;

a locking member for coupling with said gear, said locking member including a first cam member; and a second cam member, said second cam member coupled with said first cam member and movable between a first and second position, wherein in said first position said locking member being disengaged from said output gear and in said second position said locking member engaging said output gear prohibiting driving of said output spindle.

25. The screwdriver according to claim 24, wherein a drive train coupled between said motor and output spindle for driving said output spindle and said drive train including said output gear and a stationary gear housing surrounding said drive train for cooperating with said drive train.

26. The screwdriver according to claim 25, wherein said locking member coupling with said housing.

27. The screwdriver according to claim 26, wherein said locking member including teeth meshing with teeth in said housing and said locking member including teeth for engaging teeth on said output gear.

28. The screwdriver according to claim 24, wherein said first cam member including a projecting member received in a slot in said second cam member.

29. The screwdriver according to claim 24, wherein said second cam member being rotatable and axially moving said locking member on said output spindle.

30. The screwdriver according to claim 24, wherein said locking member including a gear ring having teeth on an interior surface of said ring and at least one spline on the exterior of said ring, at least one finger projecting from said ring, said finger including said first cam member for engaging said second cam member.

31. The screwdriver according to claim 30, wherein said first cam member being a pin.

32. The screwdriver according to claim 30, wherein said first cam member being a partial helical thread.

33. The screwdriver according to claim 24, wherein said second cam member including a hollow cylinder portion with a helical cam slot on an interior surface of said cylinder portion, said cam slot receiving said first cam member.

34. The screwdriver according to claim 33, wherein said cam slot being defined by partial helical threads.

35. The screwdriver according to claim 24, wherein said locking member including a ring having a friction surface for engaging and disengaging said output gear and at least one finger projecting from said ring, said finger including said first cam member for engaging said second cam member.

36. The screwdriver according to claim 35, wherein said friction face includes one or more recesses for engaging and disengaging said output gear.

* * * * *